United States Patent [19]

Thompson

[11] 4,029,127

[45] June 14, 1977

[54] FLUIDIC PROPORTIONAL AMPLIFIER

[75] Inventor: Raymond V. Thompson, Simsbury, Conn.

[73] Assignee: Chandler Evans Inc., West Hartford, Conn.

[22] Filed: Apr. 27, 1972

[21] Appl. No.: 248,330

Related U.S. Application Data

[63] Continuation of Ser. No. 1,147, Jan. 7, 1970, abandoned.

[52] U.S. Cl. ..... 137/806; 137/837

[51] Int. Cl.[2] ..... F15C 1/14

[58] Field of Search ..... 137/81.5, 837, 838, 137/839, 840, 834, 806; 123/119 R

[56] References Cited

UNITED STATES PATENTS

| | | | |
|---|---|---|---|
| 3,122,165 | 2/1964 | Horton | 137/834 |
| 3,389,894 | 6/1968 | Binder | 123/119 R X |
| 3,417,770 | 12/1968 | Denison | 137/81.5 |
| 3,469,593 | 9/1969 | O'Keefe | 137/81.5 |
| 3,495,609 | 2/1970 | Swartz | 137/81.5 |
| 3,528,443 | 9/1970 | Swartz | 137/81.5 |
| 3,539,157 | 11/1970 | Fort | 123/119 R X |
| 3,552,415 | 1/1971 | Small | 137/81.5 |

*Primary Examiner*—William R. Cline

[57] ABSTRACT

Control of a liquid power stream by establishment of a gaseous control flow is disclosed. The gaseous control flow is generated by the withdrawal of air at the boundary of the power stream to thereby create a pressure differential which deflects the power stream. Creation and control of a moving carrier flow to establish a moving boundary whereby the energy of the power stream may be modulated is also disclosed.

10 Claims, 3 Drawing Figures

INVENTOR
RAYMOND V. THOMPSON

BY Fishman & Van Kirk

ATTORNEY

FLUIDIC PROPORTIONAL AMPLIFIER

This is a continuation of application Ser. No. 1,147, filed Jan. 7, 1970, now abandoned.

BACKGROUND OF THE INVENTION

1. Field of the Invention

The present invention relates to fluidics. More specifically, the present invention relates to fluid amplifiers and particularly to proportional fluidic devices which achieve control of a stream of a first fluid by means of regulating the flow of a second fluid. Accordingly, the general objects of the present invention are to provide novel and improved methods and apparatus of such character.

2. Description of the Prior Art

As noted above, the present invention relates to the field of fluidics. Fluidics may be defined as the technology relating to the control of jets of high velocity fluid. In recent years, this field has attracted considerable attention and those skilled in the art have become aware of the numerous attributes of fluid devices such as switches and amplifiers.

Among the aforementioned attributes, the lack of moving parts in the fluidic control device has made such devices particularly attractive for control purposes. Thus, for example, it has long been desired to utilize a fluidic amplifier disposed between a source of pressurized fluid and a fluid consuming load to regulate the quantity and/or pressure of fluid delivered to the load. Such apparatus, if practical, could be employed to control the delivery of fuel to the engine of a vehicle.

The use of fluidic devices, and particularly in fuel control applications, has been hampered by several factors. Firstly, and perhaps most importantly, prior art fluid amplifiers have inherently had low gain and exceptionally low signal-to-noise ratio.

In order to conserve the power or operating stream fluid, particularly in cases where the power stream was being consumed by the load, it has been considered desirable to employ a second fluid for power stream control purposes. Attempts to utilize dissimilar fluids in a single device have previously resulted in non-linear operation due in part to the creation of turbulence and the fact that prior art devices have, as noted above, had low signal-to-noise ratio and low gain.

The low signal-to-noise ratio and, in addition thereto, non-linear response of prior art fluidic devices is in part a consequence of the fact that most of such prior devices operate on a momentum interaction principle. Thus, conventional prior art fluid amplifiers operate mainly on mechanical principles whereby the pressure of a control stream oriented substantially transversely to the power stream simply pushes the power stream in the desired direction with the amount of power stream deflection being some function of the momentum of the control stream. This momentum interaction causes flow disruption along the boundary of the power stream and thus promotes turbulent mixing with the surrounding medium. This turbulence, in turn, generates noise which results in non-linearity.

SUMMARY OF THE INVENTION

The present invention overcomes the above-discussed and other disadvantages of the prior art by providing a novel fluidic, proportional amplifier which functions as a pressure controlled actuator using unlike fluids. Since the present invention does not rely upon a momentum interaction between the control fluid and main power stream, non-linear turbulent effects are minimized and proportional amplification and high signal-to-noise ratio are obtained.

In accordance with a first embodiment of the present invention, the geometry of the device is such that attachment of the power stream to the walls of the reaction chamber is inhibited. The foregoing is achieved by suitably contouring the reaction chamber walls so that they curve away from the power stream which is expanding into the chamber. The power stream is thus essentially a free jet which mixes with the surrounding fluid to define recirculation regions within the reaction chamber. The reaction chamber is provided with a plurality of discharge ports and the deflection of the power stream to the desired discharge port is achieved by creation of a transverse pressure differential which is proportional to a control signal. The control signal is applied to a venturi system which is in communication with at least one side wall of the reaction chamber at a predetermined point intermediate the inlet nozzle and discharge ports. By placing the low pressure region created adjacent the throat of a convergent-divergent duct in the venturi system in communication with a recirculation region, entrapped air may be withdrawn from the recirculation region within the reaction chamber and the pressure differential across the power stream will be varied thereby varying jet deflection.

In the manner described above, a gas flow may be established and the position of a liquid power stream in the reaction chamber controlled thereby so that the power stream will be directed to a desired outlet port or divided between a pair of outlet ports. In addition, by establishing an additional carrier flow of fluid along a wall or walls of the reaction chamber, a moving boundary is created. The carrier flow, which may be gaseous while the main power stream is liquid, will modulate the energy of the power stream and thus amplification may be achieved by varying the moving boundary. In addition, positioning of the power stream is facilitated by deflecting from the moving boundary flow.

BRIEF DESCRIPTION OF THE DRAWING

The present invention may be better understood and its numerous objects and advantages will become apparent to those skilled in the art by reference to the accompanying drawing wherein like reference numerals refer to like elements in the several figures and in which.

DESCRIPTION OF THE DISCLOSED EMBODIMENTS

Figure 1:
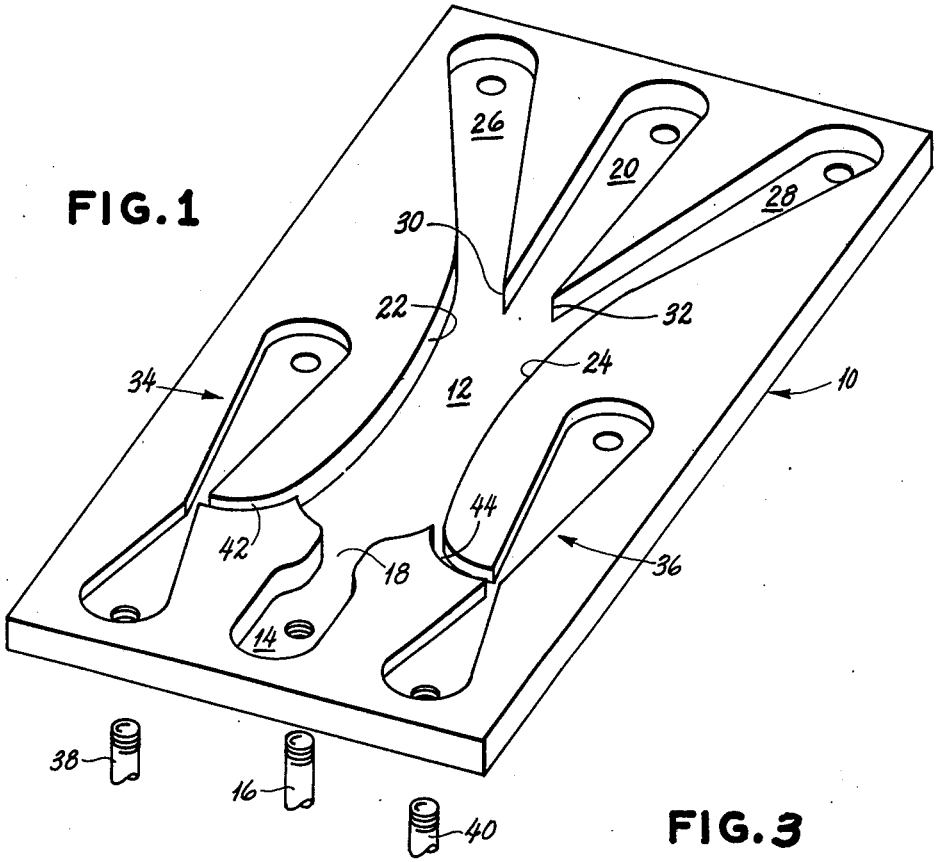
FIG. 1 is an isometric view of a first embodiment of the present invention.

With reference now to FIG. 1, a fluidic actuator in accordance with the present invention is shown. The actuator of FIG. 1 comprises a plate, indicated generally at 10, which is etched or machined to provide the desired flow path geometry. It is to be understood that, in practice, plate 10 will be clamped or bolted, etched side facing inwardly, to a cover plate which may, if necessary, have similar flow path geometry formed in the facing surface thereof.

The fluid flow paths in the embodiment of FIG. 1 include a reaction chamber 12 and means for delivering a power stream or jet of fluid to chamber 12 and receiving the deflected and/or modulated stream of fluid issuing from chamber 12. As will be described in detail below, the plate 10 is also etched to provide for a control system including ports which communicate with chamber 12.

The means for delivering the power stream to reaction chamber 12 comprises a chamber 14 which may be considered the power stream source. Chamber 14 will be in communication with a source of pressurized fluid, typically a liquid such as gas turbine engine fuel, by means of a conduit 16 whereby a source pressure $P_s$ is established in chamber 14. The source pressure $P_s$ will be maintained at a substantially constant level by means which do not comprise part of the present invention.

Source or chamber 14 is in communication with reaction chamber 12 via a restriction or passage 18. The jet discharged into chamber 12 through passage 18 will has sonic or subsonic velocity and thus will be an essentially free jet which will traverse the chamber and pass into the center dump or outlet, and thence be returned to a reservoir, unless acted upon by an outside force. As the jet passes through chamber 12 it will, however, mix with the surrounding fluid which will typically be a gas; for example air. This turbulent mixing along the boundaries of the free jet (power stream) will result in the creation of recirculation regions between the jet and walls of the reaction chamber. The pressure within the recirculation regions will be less than atmospheric and somewhat lower than the back pressure $P_A$ into which the device operates.

It is to be noted that the side walls 22 and 24 of reaction chamber 12 are curved so as to diverge from the axis of the power stream. The curvature of walls 22 and 24 is in the interest of inhibiting attachment of the power stream to the walls of the reaction chamber. The power stream is, of course, expanding slightly as it traverses reaction chamber 12 and contact between the power stream and chamber would, due to the Coanda effect, cause the device to tend to operate in a bistable mode rather than the desired proportional mode.

As noted above, the discharge or downstream end of reaction chamber 12 communicates with the receiver section which includes center dump 20. The receiver section also includes a left output 26 and a right output 28. The oppositely disposed walls which define the center dump and left and right outlet ports diverge in the downstream direction in the interest of pressure recovery and maintaining a constant back pressure within the device. The receiver section also presents a pair of knife edges 30 and 32 which function as flow dividers.

The control for the embodiment of FIG. 1 comprises a venturi system including a pair of convergent-divergent ducts indicated generally at 34 and 36. A control pressure or pressures are applied to venturis 34 and 36 respectively via conduits 38 and 40. The fluid delivered to venturis 34 and 36 may be the same as or different from the power stream fluid. If the same fluid is employed, it will be returned to the reservoir after having been used for control purposes. If the control fluid is a liquid or subsonic gas flow, a low pressure region will be established at the throat of the venturi in a manner well known in the art. If the control fluid source supplies gas at a sufficiently high pressure, due to the geometry of the venturis and the applied source pressure, supersonic flow will result downstream of the throats of ducts 34 and 36 and low pressure regions will be established downstream of the throats of the venturis. The magnitude of the pressure of these low pressure regions will be the function of the source or control pressure as applied respectively to ducts 34 and 36 via conduits 38 and 40.

The low pressure regions at or downstream of the throats of convergent-divergent ducts 34 and 36 are respectively placed in communication with the region adjacent walls 22 and 24 of reaction chamber 12 via passages 42 and 44. By varying the source of pressure upstream of the throats of the venturis 34 and 36, a pressure can be created within one or both venturis which will be less than the pressure in the recirculation regions adjacent the walls of reaction chamber 12. The pressure differential, if established, will result in the withdrawal of gas from the recirculation region. This withdrawal of gas from the recirculation regions establishes a gaseous control flow for the liquid power stream. This gaseous control flow will reduce the pressure within the recirculation region in reaction chamber 12 to thereby vary the transverse pressure differential across the power stream. The change in the pressure differential will be proportional to the control pressure applied to the venturi system and the degree of deflection of the power stream resulting from the transverse pressure differential will thus be proportional to the control signal. Additional gain may be obtained, in the case where the control flow through the venturis is a supersonic gas, by utilizing the pressure rise across the shock wave which results from the separation of the control gas from the walls of the divergent portions of the venturis.

It is particularly to be noted that fluid delivered to the venturi system may be either liquid or gas. Also, the pressure applied upstream of the throats of ducts 34 and 36 may be varied in opposite directions to achieve control, either venturi may have a reference presssure applied thereto, or different control pressures may be applied to the two venturis. Regardless of the mode of operation the present invention achieves control of a liquid supply jet by establishing a gaseous control flow and a device which inherently attempts to operate in a bistable mode is caused to exhibit proportional operation; the deflection of the power stream being proportional to the control signal established by the applied venturi system pressure or pressures.

Figure 2:
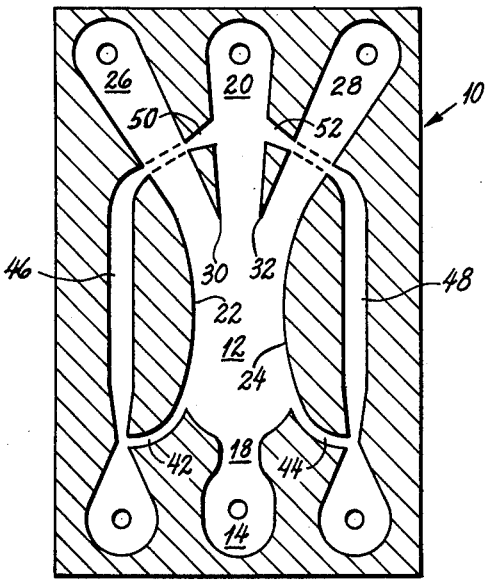
FIG. 2 is a cross-sectional, top view of a second embodiment of the present invention, the embodiment of FIG. 2 adding a liquid curtain to prevent the venting of entrained gaseous bubbles from the embodiment of FIG. 1.

Referring now to FIG. 2, a second embodiment of the present invention is illustrated. The embodiment of FIG. 2 functions in the same manner as the above-described embodiment of FIG. 1. However, there is a significant difference in that the venturis 34 and 36, rather than merely proceeding to their individual dumps, are connected via respective passages 46 and 48 to the left and right outlet ports 26 and 28. The discharge ends of passages 46 and 48 converge to define nozzles which are oriented transversely to the mouths of the associated outlet ports, the nozzles being positioned adjacent the inlets to the receiver section. Passages 50 and 52 are formed in the receiver section directly opposite the discharge ends of passages 46 and 48 and provide communication between the center dump 20 and side walls of the left and right outputs, respectively. The walls of passages 50 and 52 are preferably diverging for pressure recovery purposes.

The fluid flowing in the control venturi system will be discharged across the inlet to the left and right outlet ports as narrow jets and will initially establish a liquid curtain which prevents the venting of entrained gas bubbles with the power stream. The liquid curtains contain a given quantity of gas for entrainment, by means of isolating the reaction chamber from the gas in the outlets downstream of the curtains, and thereby decrease the lag time of the device. Restated, the liquid curtains offset the fact that the liquid jet (power stream) is initially a substantial distance from the desired reaction chamber wall and, since device gain is inversely proportional to the distance of the power jet from the wall (i.e., nonlinearly related to the quantity of gas available to the boundary regions of the jet), linearity is achieved by enhancing the gain at the low end of the curve by limiting the gas available. Once the power stream has been deflected, the liquid curtain across the outlet port receiving the gas will, of course, be ruptured.

Figure 3:
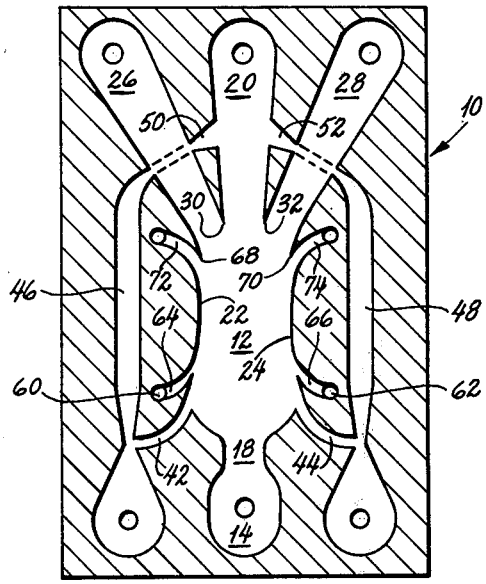
FIG. 3 is a cross-sectional, top view of a third embodiment of the present invention, the embodiment of FIG. 3 adding an independent carrier flow to the embodiment of FIG. 2 to thereby modulate the energy of the power stream.

Referring now to FIG. 3, a third embodiment of the present invention is depicted. The embodiment of FIG. 3 adds an independent flow source to the embodiments of FIGS. 1 and 2 for the purpose of augmenting the energy of the power stream. To this end, a pair of additional sources of pressurized fluid 60 and 62 are placed in communication with respective walls 22 and 24 of reaction chamber 12 via respective passages 64 and 66. Passages 64 and 66 diverge to define nozzles through which a supplementary fluid, which will typically be a gas where the power stream is a liquid, will be discharged into chamber 12. Passages 64 and 66 are oriented whereby the fluid discharged therefrom is in a direction parallel to the walls of chamber 12 and substantially tangent to the boundary of the power stream, and the supplemental fluid is discharged in the direction of motion of the power stream. The velocity of the supplementary fluid will, however, typically be substantially in excess of the power stream velocity. There will, nevertheless, be relatively insignificant momentum effects since the flow of the power jet is gross is comparison to that of the supplementary fluid.

The walls 22 and 24 of chamber 12 are etched to define knife edges 68 and 70 adjacent the receiver section of the device. These knife edges are for flow skimming purposes and divert the supplementary fluid out of reaction chamber 12 through exit ports 72 and 74.

The supplemental fluid delivered to reaction chamber 12 through ports 64 and 66 establishes carrier flow along walls 22 and 24 of the reaction chamber to thereby create a moving boundary for the power stream. This moving boundary results in improvement of the velocity profile of the power stream and therefore results in a greater portion of the power stream energy being delivered to the receiver section. In addition, by varying the velocity of the carrier flow, it is possible to modulate the output energy of the device and the apparatus may accordingly operate as a fluidic function generator. The use of the moving boundary, as established by the carrier flow, has the added advantage that the power stream may be more easily deflected from the moving boundary. Due to entrainment there will be a localized pressure drop generated as a function of the characteristics of the two substantially parallelly flowing streams. As noted above, the effect of the wall (supplemental) flow is to modify the velocity profile of the main stream by minimizing losses and maintaining main stream momentum. The venturis control main stream deflection, in the embodiment of FIG. 3, in the same manner as described above.

While preferred embodiments have been shown and described, various modifications and substitutions may be made thereto without departing from the spirt and scope of the present invention. For example, if desired or necessary to enhance the performance of the present invention, the passage 18 through which the power stream is discharged into chamber 12 may be made three dimensional in order to prevent a liquid jet from attaching to the parallel top and bottom surfaces of the reaction chamber. Accordingly, the present invention has been described by way of illustration and not limitation.

What is claimed is:

1. A fluidic device comprising:

a reaction chamber, said chamber having first and second ends and being defined by side walls;

means for establishing a stream of a first fluid across said reaction chamber from a first end thereof;

at least a pair of outlet ports positioned in said second end of said reaction chamber to receive said first fluid stream;

fluid collecting means associated with each of said outlet ports;

conduit means coupling each of said outlet ports to its respective collecting means;

means for establishing a control flow of a second fluid, said control flow establishing means communicating with at least a first side wall of said reaction chamber, said second fluid being dissimilar to said first flow and being withdrawn from the region between said stream of first fluid and reaction chamber wall whereby a variable transverse pressure differential is created and the position of said stream of first fluid with relation to said outlet ports is regulated; and means for establishing a fluid curtain across at least one of said conduit means.

2. A fluidic device comprising:

a reaction chamber, said chamber having first and second ends and being defined by side walls, a gaseous first fluid being present within said chamber;

means for establishing a stream of a second fluid across said reaction chamber from a first end thereof whereby low pressure recirculation regions of said first fluid will be created in said reaction chamber along the boundaries of said second fluid stream;

receiver means including a plurality of outlet ports at the second end of said reaction chamber, said outlet ports being positioned to receive said second fluid stream;

means for controllably withdrawing said first fluid from said reaction chamber whereby a variable transverse pressure differential is created across said second fluid stream and the position of said stream of said second fluid with respect to said outlet ports regulated; and means establishing a boundary flow of a fluid within said reaction chamber between said stream of second fluid and at least a first wall of said chamber, said boundary flow being substantially in the direction of travel of said stream of second fluid and being comprised of a fluid dissimilar in phase to said second fluid.

3. The apparatus of claim 2 wherein said second fluid is a liquid and said first and boundary fluids are gas and wherein said boundary flow establishing means comprises:

means for injecting a stream of pressurized gas into said reaction chamber via a port in at least a first side wall thereof, said gas stream being established between said side wall and said stream of first fluid; and flow skimmer means for withdrawing said boundary gas stream from said reaction chamber upstream of said receiver means.

4. A fluidic device comprising:

means defining a reaction chamber containing a first gaseous fluid, said reaction chamber having first and second ends and a pair of oppositely disposed side walls, at least portions of said oppositely disposed side walls diverging with respect to one another, said divergent side wall portions being adjacent said second end of said chamber;

means for establishing a stream of a liquid second fluid across said reaction chamber from the first end thereof, said stream of second fluid inducing low pressure recirculation regions of said first fluid in said reaction chamber along the boundaries of said stream of said second fluid, the attachment of said stream of second fluid to said chamber side walls being inhibited by the divergence of said walls in the downstream direction of said stream of said second fluid;

receiver means at the second end of said reaction chamber, said receiver means including:

at least a first pair of outlet ports in said second end of said reaction chamber, said outlet ports being positioned to receive said stream of second fluid;

fluid collecting means associated with each of said outlet ports; and conduit means coupling each of said outlet ports to its respective collecting means;

means for controllably withdrawing said first fluid from said reaction chamber recirculation regions, said withdrawing means comprising:

a pair of convergent-divergent nozzles;

means coupling sources of pressurized fluid to the convergent portions of said nozzles whereby low pressure regions are established, the pressure in said regions being a function of the applied pressures;

means for receiving fluid discharged into the divergent portions of said nozzles; and means connecting the low pressure region established in each of said nozzles to said reaction chamber, said connecting means including oppositely disposed control ports in two of said reaction chamber side walls; and means for establishing a fluid curtain across each of said conduit means.

5. The apparatus of claim 4 wherein said fluid curtain establishing means comprises:

means connecting said means for receiving fluid discharged into the divergent portions of said nozzles to respective of said conduit means.

6. The apparatus of claim 5 wherein said device further comprises:

means establishing boundary flows of gas within said reaction chamber between said two side walls and said stream of second fluid, said boundary flows being substantially parallel to said second fluid stream; and means for withdrawing said gaseous boundary flow from said chamber upstream of said receiver means.

7. A fluidic device comprising:

means defining a reaction chamber containing a first gaseous fluid, said reaction chamber having first and second ends and a pair of oppositely disposed side walls, at least portions of said oppositely disposed side walls diverging with respect to one another, said divergent side wall portions being adjacent said second end of said chamber;

means for establishing a stream of a liquid second fluid across said reaction chamber from the first end thereof, said stream of second fluid inducing low pressure recirculation regions of said first fluid in said reaction chamber along the boundaries of said stream of second fluid, the attachment of said stream of second fluid to said chamber side walls being inhibited by the divergence of said walls in the downstream direction of said stream of second fluid;

receiver means including a plurality of outlet ports at the second end of said chamber, said outlet ports being positioned to receive said stream of said second fluid;

means for controllably withdrawing said gaseous first fluid from said reaction chamber recirculation regions, said means for controllably withdrawing including:

a pair of convergent-divergent nozzles;

means coupling sources of pressurized fluid to the convergent portions of said nozzles whereby low pressure regions are established, the pressures in said regions being a function of the applied pressures;

means for receiving fluid discharged into the divergent portions of said nozzles; and means connecting the low pressure regions established in each of said nozzles to said reaction chamber, said connecting means including oppositely disposed control ports in two of said reaction chamber side walls; means establishing boundary flows of gas within said reaction chamber between said two side walls and said stream of second fluid, said boundary flows being substantially parallel to said stream of said second fluid; and means for withdrawing said gaseous boundary flow from said chamber upstream of said receiver means.

8. A method of exercizing proportional control over a stream of fluid comprising the steps of:

directing a stream of a first fluid through an interaction region in which a second dissimilar fluid is present in such a manner as to prevent attachment of the stream of first fluid to a surface and to establish low pressure recirculation regions of said second fluid along oppositely disposed boundaries of the stream of first fluid within the region;

independently bleeding off the second fluid from the recirculation regions at opposite boundaries of the stream of first fluid to thereby vary the transverse pressure differential across the stream of first fluid and adjustably vary the deflection of said first fluid stream from a normal axis; and establishing a moving boundary flow of a fluid dissimilar in phase to said first fluid within the interaction region, said boundary flow being substantially in the direction of travel of said stream of first fluid.

9. The method of claim 8 wherein the stream of fluid may be deflected so as to exit the interaction region via selected outlet ports, the method further comprising the step of:

establishing a fluid curtain in the vicinity of at least one of the outlet ports.

10. The method of claim 8 wherein the stream of fluid may be deflected so as to exit the interaction region via selected outlet ports, the method further comprising the step of:

establishing a fluid curtain in the vicinity of at least one of the outlet ports.

* * * * *